US009097472B2

(12) United States Patent
Kondo et al.

(10) Patent No.: US 9,097,472 B2
(45) Date of Patent: Aug. 4, 2015

(54) METHOD OF PRODUCING A HEAT EXCHANGER

(75) Inventors: Hiroaki Kondo, Shizuoka-ken (JP); Hisashi Segawa, Shizuoka-ken (JP)

(73) Assignee: Usui Kokusai Sangyo Kaisha, Ltd., Shizuoka-ken (JP)

( * ) Notice: Subject to any disclaimer, the term of this patent is extended or adjusted under 35 U.S.C. 154(b) by 506 days.

(21) Appl. No.: 13/508,499

(22) PCT Filed: Oct. 28, 2010

(86) PCT No.: PCT/JP2010/006366

§ 371 (c)(1), (2), (4) Date: Jul. 6, 2012

(87) PCT Pub. No.: WO2011/055515

PCT Pub. Date: May 12, 2011

(65) Prior Publication Data

US 2012/0273182 A1 Nov. 1, 2012

(30) Foreign Application Priority Data

Nov. 5, 2009 (JP) ..... 2009-254191

(51) Int. Cl.

| | |
|---|---|
| ***F28F 13/12*** | (2006.01) |
| ***B21D 53/02*** | (2006.01) |
| ***F28F 1/12*** | (2006.01) |

(52) U.S. Cl.

CPC ..... *F28F 13/12* (2013.01); *B21D 53/022* (2013.01); *F28F 1/126* (2013.01); *B21D 53/02* (2013.01); *F28F 2215/00* (2013.01); *Y10T 29/4935* (2015.01); *Y10T 29/4938* (2015.01); *Y10T 29/49378* (2015.01)

(58) Field of Classification Search

CPC ..... B21D 53/022; B21D 53/025; F28F 13/12; F28F 1/126; F28F 2215/00; B21C 37/22; B21C 37/225; B21C 37/24; B21C 37/26; Y10T 29/4938; Y10T 29/4935; Y10T 29/49378

USPC ..... 29/890.047, 890.03; 165/150, 151, 185

See application file for complete search history.

(56) References Cited

U.S. PATENT DOCUMENTS

| | | | | |
|---|---|---|---|---|
| 6,622,785 | B2 * | 9/2003 | Haegele et al. | 165/177 |
| 6,688,380 | B2 * | 2/2004 | Lavochkin et al. | 165/150 |
| 2004/0000396 | A1 | 1/2004 | Lavochkin et al. | |
| 2007/0034366 | A1 * | 2/2007 | Igami et al. | 165/177 |
| 2007/0062677 | A1 | 3/2007 | Usui et al. | |

FOREIGN PATENT DOCUMENTS

| | | |
|---|---|---|
| JP | 55-175797 | 12/1980 |

(Continued)

*Primary Examiner* — Sarang Afzali

(74) *Attorney, Agent, or Firm* — Jordan and Hamburg LLP

(57) ABSTRACT

A fin member for a heat exchanger is produced by repeatedly folding a plate over itself into a corrugated shape to form corrugated fins. The folded sections which are formed by the folding are pressed and deformed into a recessed shape to form engagement recesses. A pipe member through which fluid flows is disposed at the engagement recesses. The pressing and deformation of the engagement recesses cause swollen sections to protrude at both sides of each folded section with respect to the folding-over direction of the folded section and form flat butt surfaces at the tips of the swollen sections. Adjacent butt surfaces are caused to be in surface contact with each other with the pipe member disposed at the engagement recesses.

2 Claims, 8 Drawing Sheets

(56) References Cited

FOREIGN PATENT DOCUMENTS

| | | |
|---|---|---|
| JP | 1-181092 | 7/1989 |
| JP | 2000-220982 | 8/2000 |
| JP | 2005-201622 | 7/2005 |
| JP | 2006-507467 | 3/2006 |

* cited by examiner

METHOD OF PRODUCING A HEAT EXCHANGER

BACKGROUND OF THE INVENTION

The present invention relates to a fin member for use in heat absorption and desorption pipework for various fluids such as fuel pipes, oil pipes and the like for automotive and general industrial applications, EGR gas coolers, air conditioners for regulating temperature and/or humidity in residential spaces, and other heat exchangers, aiming to obtain a heat exchanger that excels in heat exchange performance and efficiency of assembly.

Conventionally, as a fin member for use in heat absorption and desorption pipework for various fluids such as fuel pipes, oil pipes and the like for automotive and general industrial applications, EGR gas coolers, air conditioners for regulating temperature and/or humidity in residential spaces, and other heat exchangers, a kind such as shown in patent document JP-2005-201622 A has been generally known. According to this conventional technology, plate material is folded into a corrugated shape, while, as shown in FIG. 8, the folded sections (30) formed by the folding are pressed and deformed into a recessed shape to form engagement recesses such that a pipe member through which fluid flows can be disposed at the engagement recesses. The deformation pressing of the engagement recesses causes swollen sections (34) to protrude at both sides of each fin's (33) folded section (30), and with a pipe member (32) disposed at the engagement recesses (31), swollen sections (34) of neighbouring folded sections (30) are brought into linear or punctual contact with each other.

SUMMARY OF THE INVENTION

However, although in accordance with the above patent document swollen sections (34) are formed at the engagement recesses (31) formed in the folded section (30) of every fin (33), when a pipe member (32) is assembled onto the fin member (35) and a pressing force in axial direction of the pipe member (32) is applied to the fins (33), the swollen sections (34) of the respective fins (33) make point-shaped or line-shaped contact with each other. Therefore, the mutual contact of the swollen sections (34) becomes unstable, such that at the time of said assembly situations may easily arise where the contacting portions of swollen sections (34) slip in radial direction of the pipe member (32) or, as shown in FIG. 8, one of two contacting swollen sections (34) rides over the other.

When in this way slippage in radial direction of the pipe member (32) or ride-over occurs at the contacting portions of the swollen sections (34), the fin member (35) deforms irregularly such that the engagement recesses (31) can no longer be kept on the same arc surface, and it becomes difficult to stably mount the pipe member (32) onto the engagement recesses (31) of the fin member (35). Moreover, as to those portions where slippage in radial direction of the pipe member (32) or ride-over have occurred, non-contacting portions (36) arise between the engagement recesses (31) and the circumferential surface of the pipe member (32) that make it difficult to bring both into contact, causing the heat conducting area to diminish and bringing about a danger of decreasing heat exchange performance. Furthermore, at the non-contacting portions (36) dirt, sediments and the like are liable to build up, promoting the occurrence of corrosion of the fin member (35) and the pipe member (32). Also, because as explained above the swollen sections (34) of the fins (33) are able to be brought into mutual contact in point-shaped or line-shaped fashion only, the contact area between the folded sections (30) of the fins (33) also becomes small in comparison to a case where the swollen sections (34) are brought into surface contact with each other. This leads to a lack in stability of the shape of the fins (33) and the overall shape of the fin member (35), together with the thermal conduction between the folded sections (30) becoming unstable such that the heat exchange performance is liable to drop.

The present invention attempts to solve the above-mentioned problems, by stabilising the mutual contact between the swollen sections of the fins to prevent ride-over and slippage in radial direction of the pipe member from occurring at the contacting portions of the fins, such that when, in order to make every contacting portion of the fin member adhere reliably, a sufficient pressing force is exerted on the pipe member and the fin member, irregular deformation of the fin member is suppressed and stable mounting of a pipe member to the fin member enabled, while preventing the contact area of the fin member and the pipe member as well as the mutual contact area of the folded section of the fins from diminishing to improve heat exchange performance. Moreover, it aims at preventing corrosion of the fin member and pipe member due to adherence of dirt, sediments and the like for improved durability.

According to the present invention, in order to solve the above-mentioned problems, a plate material is repeatedly folded over itself into a corrugated shape to form corrugated fins. The folded sections, which are formed by the folding, are deformed by pressing into a recessed shape to form engagement recesses. A pipe member for passing a fluid therethrough is engagingly disposable at the engagement recesses. The deformation by pressing of the engagement recesses causes swollen sections to protrude at both sides of each folded section with respect to the folding-over direction of the folded section and form flat butt surfaces at the tips of the swollen sections, such that adjacent butt surfaces are caused to be in surface contact with each other when a pipe member is disposed at the engagement recesses.

Furthermore, the butt surfaces may be formed to become perpendicular to a pipe axis direction of a pipe member engagingly disposed on the fin member. Due to the formation in this way, when neighbouring butt surfaces are brought into surface contact, the contact surfaces are disposed perpendicular to the the pipe axis direction of the pipe member. Therefore, even if a large pressing force is applied in axial direction of the fin member during mounting of a pipe member to the fin member, this large pressing force will act perpendicularly on the reciprocal contact surfaces of the butt surfaces such that the occurrence of a force in radial direction of the pipe member is suppressed all the more effectively, and at the portions of mutual contact between the butt surfaces slippage in radial direction of the pipe member will not occur. Therefore, it becomes possible to press the fin member with said large pressing force to increase the contact surface pressure between the butt surfaces, thus enlarging the thermally conducting area for further improvement of the heat exchange performance.

Moreover, the cross-sectional contour shape of the engagement recesses may be an arc shape, an oval shape, an elliptical shape, or similar shape matched to the cross-sectional contour shape of the pipe member.

Because according to the present invention, as mentioned above, flat butt surfaces are provided at the tip of each swollen section in preferably perpendicular orientation to the central axis of the pipe member to be engaged, when assembling the pipe member with the fin member, even if each part is pressed with a strong pressing force in order to increase the contact surface pressure at all areas of contact between the pipe member and fin member, it becomes possible to bring the flat butt surfaces of neighbouring fins into surface contact with each other while hindering the occurrence of forces in radial direction of the pipe member between the contact surfaces. Therefore, compared to a case where the swollen sections are mutually brought into linear or punctual contact, forces in radial direction of the pipe member are unlikely to occur, assembly is enabled to be stabilised, and ride-over as well as slippage in radial direction of the pipe member are inhibited even when a pressing force in the folding-over direction of the fins acts on the contacting portions of the swollen sections. Therefore, because the engagement recesses formed in the fin member are kept on the same arc surface, the pipe member is stably engaged and assembled with the fin member, and the circumferential surface of the pipe member can be brought by strong surface pressure into reliable surface contact with all engagement recesses formed in the fin member, such that it becomes possible to increase the area of thermal conduction for improved heat exchange performance.

Moreover, because by preventing, as described above, ride-over and slippage in radial direction of the pipe member from occurring at the contacting portions of the swollen sections to thereby maintain all engagement recesses of the fin member on the same arc surface, all engagement recesses of the fin member can be brought into reliable surface contact with the circumferential surface of the pipe member to make intervening gaps disappear or become extremely small, the fin member and pipe member are prevented from corroding due to intrusion of dirt, sediments and the like, such that also corrosion resistance and longevity are simultaneously achieved.

EMBODIMENT 1

Figure 1:
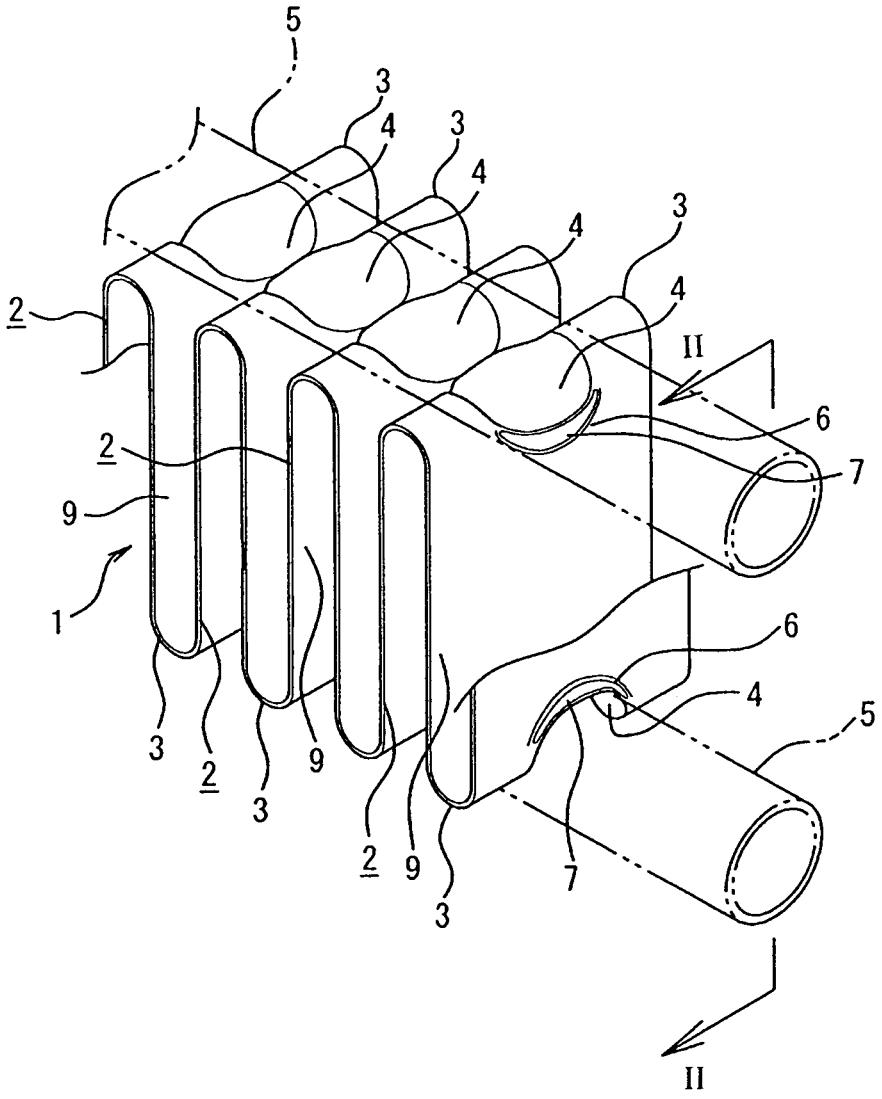
FIG. 1 is a perspective view showing a fin member in accordance with Embodiment 1.
Figure 2:
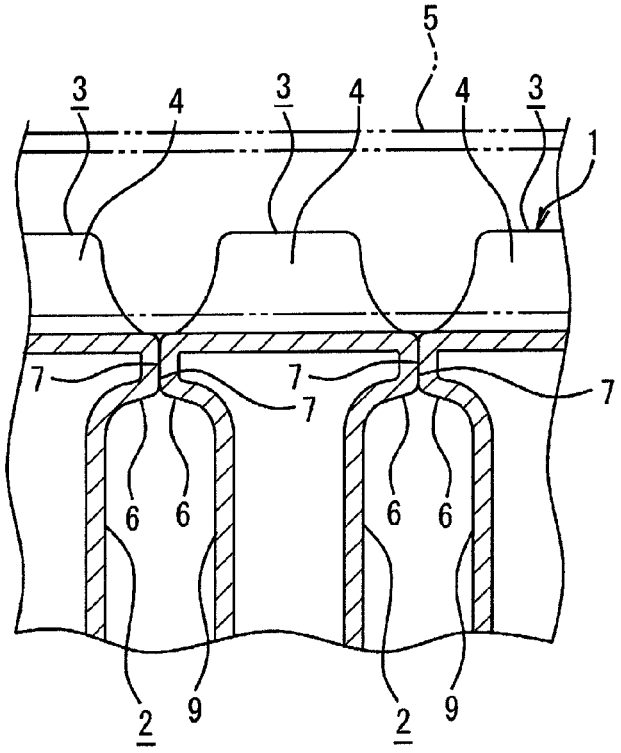
FIG. 2 is a cross-sectional view along line A-A in FIG. 1.

To explain Embodiment 1 of the invention on the basis of FIGS. 1 to 6, (1) is a fin member formed, as shown in FIG. 1, by successively subjecting a belt-shaped plate material to repeated alternate folding into a corrugated shape to stack up a plurality of fins (2) composed of flat sections (9) and folded sections (3). In the fin member (1), the apex of each folded section (3) formed by the above folding is deformed into a recessed shape by pressing inwardly in direction perpendicular to the stacking direction of the plurality of fins (2) to form corresponding engagement recesses (4) at the apex of each folded section (3), thereby enabling a pipe member (5) for passing a fluid, as shown in FIGS. 1 and 2, to be engagingly arranged within an arc-shaped surface formed by the engagement recesses (4). Furthermore, it sometimes may occur that the flat sections (9) become slightly distorted due to external forces acting, for example, at the time of folding or the time of engagingly arranging the pipe member (5) onto the fin member (1) and in consequence are unable to present a perfectly flat surface.

Figure 4:
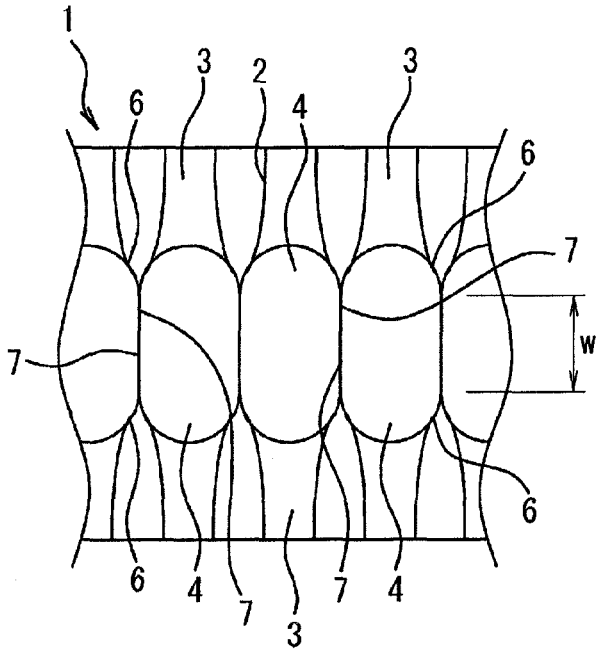
FIG. 4 is a top view of the fin member.
Figure 5:
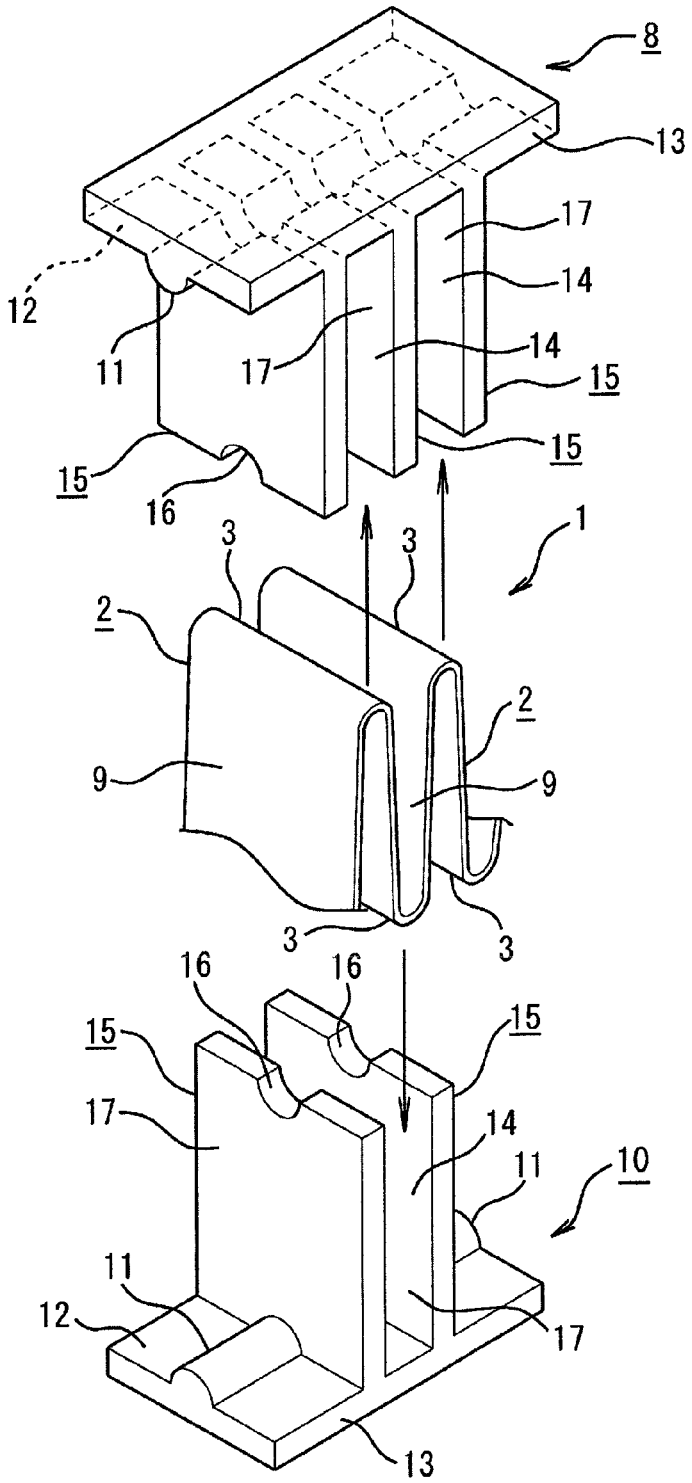
FIG. 5 is a perspective view showing the fin member with a top die and a bottom die for forming engagement recesses and butt surfaces.

Moreover, in the fin member (1), as shown in FIG. 2, along with the forming of the engagement recesses (4), swollen sections (6) are induced to protrude from the folded sections (3) toward both sides in stacking direction. At the tip of the swollen sections (6), as shown in FIG. 4, substantially crescent-shaped flat butt surfaces (7) are formed perpendicular to the axial direction of the pipe member (5), i.e. the stacking direction of the fins (2). In the present embodiment, by making use of a top die (8) and a bottom die (10), deformation pressing of the engagement recesses (4) is performed that incorporates formation of the butt surfaces (7). The top die (8) and the bottom die (10), as shown in FIG. 5, are composed of a base section (13) with protrusions (11) of semicircular cross-sectional shape formed protruding in-line from one side (12), and of protruding walls (15) formed protruding perpendicularly to the central axis of the protrusions (11) at uniform intervening spacing (14) from said one side (12) of the base section (13). On the protruding walls (15), at the centre of the end thereof, respective arc-shaped channels (16) are formed, which are matched to the protrusions (11) such that the curvature radii differ by the plate thickness dimension. When the top die (8) and the bottom die (10) are combined as shown in FIG. 6, the protrusions (11) of the top die (8) and the channels (16) of respective protruding walls (15) of the bottom die (10), as well as the protrusions (11) of the bottom die (10) and the channels (16) of respective protruding walls (15) of the top die (8), engage each other.

Then, as indicated by arrows in FIG. 5, the fins (2) of the fin member (1) are arranged within the spacing (14) of the protruding walls (15) of the bottom die (10) and the top die (8), the folded sections (3) of the fins (2) being arranged individually between the protrusions (11) of the top die (8) and the channels (16) of the protruding walls (15) of the bottom die (10), as well as between the protrusions (11) of the bottom die (10) and the engagement recesses (4) of the protruding walls (15) of the top die (8). In this state, as shown in FIG. 6, the top die (8) and the bottom die (10) are pushed against each other. In consequence, the folded sections (3) of the fins (2), which are sandwiched between the protrusions (11) of the top die (8) and the channels (16) of the protruding walls (15) of the bottom die (10) as well as between the protrusions (11) of the bottom die (10) and the channels (16) of the protruding walls (15) of the top die (8), deform along the curved shape of the protrusions (11) and channels (16) such that, as shown in FIGS. 1 to 4, the engagement recesses (4) at the folded sections (3) of the fin member (1) are formed.

Figure 6:
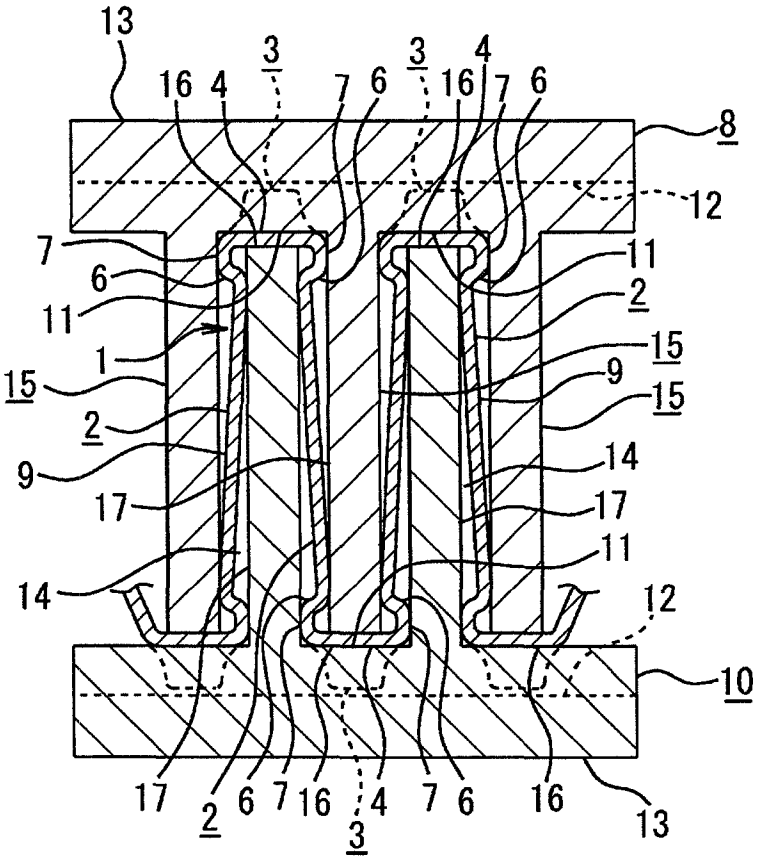
FIG. 6 is a cross-sectional view showing the process of forming the engagement recesses and butt surfaces in the fin member.

Moreover, when in this way press-deforming the apices of the folded sections (3) inwardly in direction perpendicular to the stacking direction of the fins (2), in co-occurrence with the same, as shown in FIG. 6, the swollen sections (6) protrude from the folding sections (3) toward both sides in stacking direction, such that the tips of the swollen sections (6) hit against the flat wall surfaces (17) of the protruding walls (15) of the top die (8) and the bottom die (10), which are perpendicular to the stacking direction of the fins (2), to respectively form the flat butt surfaces (7) at the tip of each swollen section (6). By employing a top die (8) and a bottom die (10) in this way, in the present embodiment the process of forming the engagement recesses (4) at each fin (2) of the fin member (1) is performed simultaneously with the process of forming the flat butt surfaces (7) perpendicular to the stacking direction of the fins (2) at each swollen section (6), thus enabling to achieve process speedup and optimisation.

Moreover, the forming of fiat butt surfaces (7) in this way at the tip of each swollen section (6) brings, as shown in FIG. 2, the flat butt surfaces (7) of neighbouring fins (2) into surface contact with each other when assembling a pipe member (5) with the fin member (1), even if each part is pressed with a strong pressing force in order to increase the contact surface pressure at all areas of contact between the pipe member (5) and fin member (1), while hindering the occurrence of forces in radial direction of the pipe member (5) between the contact surfaces. Therefore, compared to a case where the swollen sections (6) are mutually brought into linear or punctual contact, forces in radial direction of the pipe member (5) are unlikely to occur, assembly is stabilised, and ride-over as well as slippage in radial direction of the pipe member (5) are inhibited even when a pressing force in the stacking direction of the fins (2) acts on the contacting portions of the swollen sections (6). Therefore, because the engagement recesses (4) formed in the fin member (1) are kept on the same arc surface, the pipe member (5) is stably engaged and assembled with the fin member (1), and the circumferential surface of the pipe member (5) is brought by strong surface pressure into reliable surface contact with all engagement recesses (4) formed in the fin member (1), such that it becomes possible to increase the area of thermal conduction for improved heat exchange performance.

Moreover, because by preventing, as described above, ride-over and slippage in radial direction of the pipe member (5) from occurring at the contacting portions of the swollen sections (6) to thereby maintain all engagement recesses (4) of the fin member (1) on the same arc surface, all engagement recesses (4) of the fin member (1) are brought into reliable surface contact with the circumferential surface of the pipe member (5) to make intervening gaps disappear or become extremely small, the fin member (1) and pipe member (5) are prevented from corroding due to intrusion of dirt, sediments and the like, such that also corrosion resistance and longevity are enabled to be simultaneously achieved.

Moreover, because by bringing, as described above, the flat butt surfaces (7) formed in swollen sections (6) of neighbouring folded sections (3) of the fin member (1) into reliable surface contact with each other, the area of contact between adjacent fin members (1) is increased in comparison to a case where the butt surfaces (7) are brought into linear or punctual contact, such that also in this respect heat exchange performance is improved.

Figure 3:
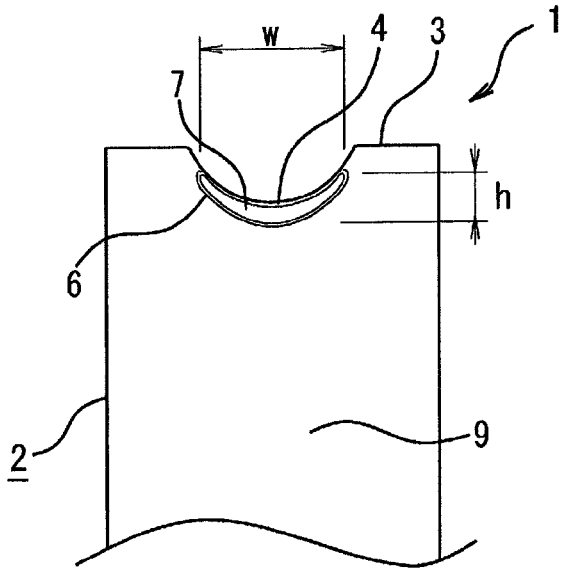
FIG. 3 is a side view of the fin member.

Moreover, because in the present embodiment the butt surfaces (7) of each fin (2) of the fin member (1) are formed to become perpendicular to the pipe axis direction of a pipe member (5) that is to be assembled with the fin member (1), as shown in FIGS. 3 and 4, when the butt surfaces (7) mutually are brought into surface contact, their contacting surfaces will be disposed perpendicular to the pipe axis direction of the pipe member (5). Therefore, even if a large pressing force is applied in axial direction of the fin member (1) during attachment of a pipe member (5) to the fin member (1), this large pressing force will act perpendicularly to the surfaces of mutual contact of the butt surfaces (7) such that the occurrence of a force in radial direction of the pipe member (5) is suppressed all the more effectively, and at the portions of mutual contact between the butt surfaces (7) slippage in radial direction of the pipe member (5) will not occur. Therefore, it becomes possible to press the fin member (1) with said large pressing force to increase the contact surface pressure between the butt surfaces (7), thus enlarging the thermally conducting area for further improvement of the heat exchange performance.

Preferably, the butt surfaces (7) are formed with a height of 0.5 mm to 2.5 mm, and a width of 4.5 mm to 6.5 mm. Further, in the present description the "height" of a flat butt surface (7), as indicated by the arrows h in FIG. 3, refers to the distance from the top to the bottom of the butt surface (7), whereas the "width" of the butt surface, as indicated by the arrows w in FIGS. 3 and 4, refers to the distance from one tip to the other. If the height of the butt surfaces (7) is less than 0.5 mm or the width of the butt surfaces (7) is less than 4.5 mm, contact between the butt surfaces (7) will be insufficient when the butt surfaces (7) are brought into contact with each other, such that it may easily happen that the swollen section (6) on one side will ride over the swollen section (6) on the other side, or that a slippage in radial direction of the pipe member (5) will occur at the position of contact. And, if the height of the butt surfaces (7) is made greater than 2.5 mm or the width of the butt surfaces (7) is made greater than 6.5 mm, the formation width, formation depth and the like of the engagement recesses (4) have to be made undesirably large, risking to cause cracks to appear at the engagement recesses (4) of the fin member (1), particularly in the vicinity of the rim of the butt surfaces (7).

EMBODIMENT 2

Figure 7:
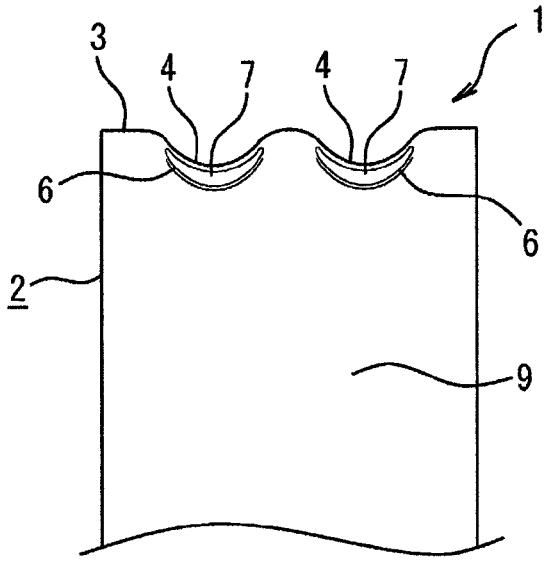
FIG. 7 is a side view of a fin member in accordance with Embodiment 2.
Figure 8:
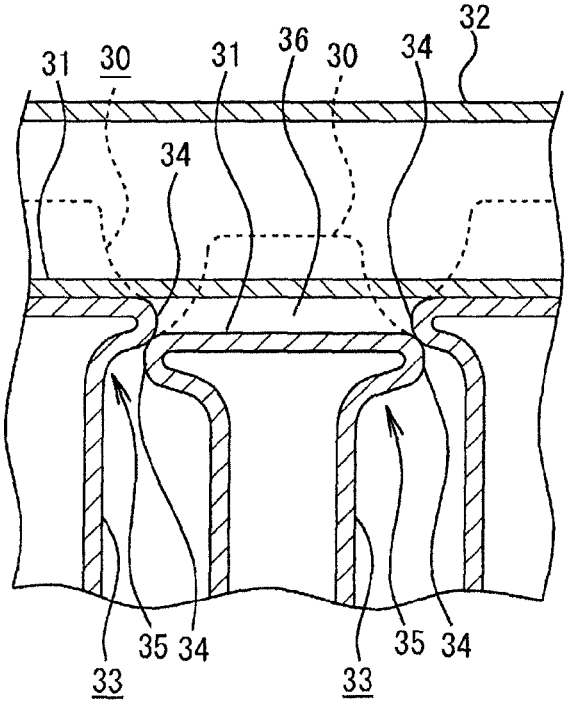
Fig. 8 PRIOR ART
FIG. 8 is a cross-sectional view showing an example of a conventional fin member in a state where swollen sections have ridden over each other.

Whereas in Embodiment 1 above, as shown in FIG. 1, engagement recesses (4) are provided one-by-one at each folded section (3) of the fin member (1), in the present Embodiment 2, as shown in FIG. 7, two engagement recesses (4) are formed at each folded section (3), spaced apart in the width direction of the folded section (3). Because the present embodiment enables, by forming more than one engagement recess (4) per folded section (3), to arrange a plurality of pipe members (5) on one fin member (1), the contact area between the fin member (1) and the pipe members (5) is enlarged in comparison to a case where only one pipe member (5) is arranged on one fin member (1), thereby achieving an improved heat exchange performance. However, in case that a plurality of engagement recesses (4) is formed per folded section (3) as in the present embodiment, when the formation spacing of the individual engagement recesses (4) is made too narrow there is a risk that neighbouring swollen sections (6) will interfere with each other, such that the swelling of the swollen sections (6) is suppressed, and the formation of the butt surfaces (7) cannot be sufficiently performed.

In present Embodiment 2 and above Embodiment 1, cases have been explained where engagement recesses (4) of arc-shaped cross-sectional contour shape are formed in the fin member (1). However, in other different embodiments it is also possible to make the cross-sectional contour shape of the engagement recesses (4) an arbitrary shape such as an oval shape or elliptic shape that matches a cross-sectional shape of the pipe member (5).

What is claimed is:

1. A method of producing a heat exchanger, comprising:

repeatedly folding a plate material, which has a first length and a first width, along said first length into a corrugated shape having alternating folded sections and straight sections of said first width, wherein a first plurality of the folded sections are aligned at a first height and a second plurality of the folded sections are aligned at a second height;

pressing the folded plate material into a die having a base section with protrusions and protruding walls extending from a surface of the base section, the protruding walls being of uniform spacing;

deforming, in response to said pressing, a first portion of each one folded section of the first plurality of folded sections by pressing said plate material against said protrusions, each one said first portion spanning less than said first width and spanning at least a length of said one folded section, said length of said one folded section being greater than a spacing between a first straight section and a second straight section to each side of said one folded section, said first straight section and second straight section being among said alternating folded sections and straight sections, wherein each one said deformed first portion is configured by said pressing to form a recess, wherein each said formed recess among said first plurality of folded sections is aligned to form a groove configured to receive a pipe section of the heat exchanger;

forming a bulge, during said deforming, in said first portion as plate material is forced against said corresponding protrusion so that the plate material is forced against walls of said protruding walls of said die resulting in a first and a second flat abutment surface of the deformed first portion in contact with said protruding walls;

separating the pressed, folded plate material from said die, wherein said pressed, folded plate material serves as a fin member for the heat exchanger; and assembling the pipe section into said groove, wherein said first flat abutment surface for said one folded section is moved into flat abutment with said second flat abutment surface for a neighboring another of said first plurality of folded sections, so that said groove comprises each one of said aligned, configured recesses in serial abutment; and wherein said aligned, configured recesses in serial abutment have a common depth.

2. The method according to claim 1, wherein the recesses in serial abutment comprise an arc-shaped, ovally shaped, or elliptically shaped cross-sectional contour shape.

* * * * *